US007862689B2

(12) United States Patent
Kawasaki et al.

(10) Patent No.: US 7,862,689 B2
(45) Date of Patent: Jan. 4, 2011

(54) WATER CONTENT ESTIMATION APPARATUS, SHEET MATERIAL PROCESSING APPARATUS, WATER CONTENT ESTIMATION METHOD, AND SHEET MATERIAL PROCESSING METHOD

(75) Inventors: Takehiko Kawasaki, Kamakura (JP); Norio Kaneko, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 690 days.

(21) Appl. No.: 11/745,676

(22) Filed: May 8, 2007

(65) Prior Publication Data

US 2007/0279447 A1 Dec. 6, 2007

(30) Foreign Application Priority Data

May 30, 2006 (JP) ..... 2006-150706

(51) Int. Cl.
*D21F 7/06* (2006.01)
*G03G 21/20* (2006.01)

(52) U.S. Cl. ..... 162/263; 162/198; 162/265; 162/134; 73/159; 399/44; 399/45; 347/19

(58) Field of Classification Search ..... 162/198, 162/204, 207, 252, 253, 263, 265, 361, 134, 162/DIG. 6; 250/339.1, 390.05; 73/159; 399/44, 45, 97; 347/1, 14, 16, 19, 188; 430/30; 101/484
See application file for complete search history.

(56) References Cited

U.S. PATENT DOCUMENTS 3,171,034 A 2/1965 Tomasulo et al.
3,822,588 A 7/1974 Knight et al. ..... 73/81
3,826,487 A 7/1974 Förster et al. ..... 271/263
4,060,734 A 11/1977 Tilley et al. ..... 250/560
4,134,147 A * 1/1979 Watanabe ..... 361/235
4,141,253 A 2/1979 Whitehead, Jr. ..... 73/727
4,519,245 A 5/1985 Evans ..... 73/579
4,610,530 A * 9/1986 Lehmbeck et al. ..... 399/69
4,688,423 A 8/1987 Orkosalo ..... 73/159
4,847,638 A 7/1989 Moriyama ..... 346/140 R
4,864,851 A 9/1989 Haughton ..... 73/159
4,866,984 A 9/1989 Houghton ..... 73/159
4,912,515 A * 3/1990 Amemiya et al. ..... 399/44
4,970,895 A 11/1990 Houghton et al. ..... 73/159
4,986,883 A * 1/1991 Taipale et al. ..... 162/205
4,991,432 A 2/1991 Houghton et al. ..... 73/159
5,101,661 A 4/1992 Cresson et al. ..... 73/159

(Continued)

FOREIGN PATENT DOCUMENTS

JP 5-204411 8/1993

(Continued)

*Primary Examiner*—Eric Hug
(74) *Attorney, Agent, or Firm*—Fitzpatrick, Cella, Harper & Scinto

(57) ABSTRACT

Information (particularly, water content) of a sheet material which changes during progression of processing is estimated with higher accuracy and information output or (image formation) processing is performed. The water content estimation method of the present invention includes: detecting a first information regarding moisture contained in a sheet material; detecting a second information regarding a factor affecting information regarding the moisture contained in the sheet material; predicatively computing an estimation of a water content of the sheet material based on the first information and the second information; and adjusting processing conditions for image formation based on the estimation of the water content which is computed.

6 Claims, 8 Drawing Sheets

U.S. PATENT DOCUMENTS

| | | | | |
|---|---|---|---|---|
| 5,136,202 | A | 8/1992 | Carenzo et al. | 310/330 |
| 5,138,878 | A | 8/1992 | Cresson et al. | 73/159 |
| 5,171,403 | A | 12/1992 | Chase et al. | 162/197 |
| 5,188,983 | A | 2/1993 | Guckel et al. | 437/209 |
| 5,465,135 | A * | 11/1995 | Nakagama et al. | 399/44 |
| 5,486,063 | A | 1/1996 | Fox et al. | 400/708 |
| 5,488,457 | A * | 1/1996 | Nakagama et al. | 399/44 |
| 5,499,807 | A | 3/1996 | Nakamura et al. | 271/121 |
| 5,533,399 | A | 7/1996 | Gibson et al. | 73/579 |
| 5,606,113 | A | 2/1997 | Sheen et al. | 73/32 A |
| 5,678,678 | A | 10/1997 | Brandt, Jr. et al. | 194/206 |
| 5,934,140 | A | 8/1999 | Jackson et al. | 73/159 |
| 6,026,681 | A | 2/2000 | Wunderer et al. | 73/159 |
| 6,065,746 | A | 5/2000 | Tranquilla | 271/176 |
| 6,157,793 | A * | 12/2000 | Weaver et al. | 399/45 |
| 6,223,004 | B1 * | 4/2001 | Kodama | 399/44 |
| 6,365,895 | B1 | 4/2002 | Yamamoto | 250/306 |
| 6,467,977 | B2 | 10/2002 | Luque et al. | 400/56 |
| 6,485,205 | B2 | 11/2002 | Luque | 400/56 |
| 6,560,417 | B1 * | 5/2003 | Rodriguez | 399/27 |
| 6,561,509 | B2 | 5/2003 | Kettenmann et al. | 271/263 |
| 6,584,703 | B1 * | 7/2003 | Maenpaa et al. | 34/446 |
| 6,771,913 | B2 * | 8/2004 | Jeschonek et al. | 399/49 |
| 6,776,543 | B1 | 8/2004 | Hall et al. | 400/56 |
| 6,816,686 | B2 * | 11/2004 | Hooper et al. | 399/44 |
| 6,866,263 | B2 | 3/2005 | Kawasaki | 271/262 |
| 7,043,962 | B2 | 5/2006 | Sakai | 73/12.01 |
| 7,082,832 | B2 | 8/2006 | Yabuta et al. | 73/597 |
| 7,376,368 | B2 * | 5/2008 | Taira et al. | 399/97 |
| 2003/0053089 | A1 | 3/2003 | Nojiri et al. | 358/1.9 |
| 2003/0053090 | A1 | 3/2003 | Nojiri et al. | 358/1.9 |
| 2004/0059534 | A1 | 3/2004 | Nojiri | 702/115 |
| 2004/0094458 | A1 | 5/2004 | Akaike | 209/599 |
| 2006/0016996 | A1 | 1/2006 | Kaneko et al. | 250/339.1 |
| 2006/0022400 | A1 | 2/2006 | Kawasaki et al. | 271/227 |
| 2006/0054842 | A1 | 3/2006 | Kawasaki et al. | 250/559.04 |

FOREIGN PATENT DOCUMENTS

| | | | |
|---|---|---|---|
| JP | 7-234556 | | 9/1995 |
| JP | 9-5284 | | 1/1997 |
| JP | 11-202686 | | 7/1999 |
| WO | WO 03/069060 | * | 8/2003 |

* cited by examiner

WATER CONTENT ESTIMATION APPARATUS, SHEET MATERIAL PROCESSING APPARATUS, WATER CONTENT ESTIMATION METHOD, AND SHEET MATERIAL PROCESSING METHOD

BACKGROUND OF THE INVENTION

1. Field of the Invention

The present invention relates to a water content estimation apparatus and a water content estimation method for estimating a water content of a sheet material, specifically to an apparatus and a method for estimating an accurate water content of the sheet material when the sheet material is actually processed, by correcting a water content detected before the sheet material is processed; and to a sheet material processing apparatus including the water content estimation apparatus, and a sheet material processing method including the water content estimation method.

2. Description of the Related Art

In an image formation apparatus using an electrophotographic technology, a water content of a sheet material on which image formation is performed greatly affects an image quality and processing stability. This is because when the water content increases, resistivity of the sheet material decreases, thereby deteriorating transferring performance of a toner image and separation performance thereof from a photosensitive drum. In a fixing processing in which heating and pressing are performed, due to heat of evaporation of moisture contained in the sheet material, there is caused fluctuation in effective fixing temperature.

In recent years, in a sheet material processing apparatus as represented by an image formation apparatus (such as LBP or copying machine), with increasing demand for higher image quality and higher processing speed, optimization control of processing conditions complying with each of various states of the sheet material has been performed.

One of the most important sheet materials processed by the sheet material processing apparatus is paper. Mechanical and electrical characteristics of paper greatly fluctuate according to its water content. Therefore, as information on the sheet material, the water content is particularly important.

Conventionally, an attempt is made to control the processing conditions for the sheet material by measuring the water content of the sheet material in the sheet material processing apparatus. Japanese Patent Application Laid-Open No. H07-234556 discloses a water content detection apparatus, which applies projection light to an object to be measured, for measuring the thickness and water content of the sheet material from a reflection light amount. In this case, the water content is measured based on humidity of the object to be measured and on a distance from a humidity detection unit to the object to be measured. Based on a result of comparison between the measured water content and a predetermined value, the water content of the object to be measured is computed. Then, based on the computation result, various image forming conditions are corrected. Alternatively, based on a distance between a humidity detection unit and a recording sheet (sheet material), the water content of the object to be measured is computed.

However, paper which is a sheet material mainly used in the image formation apparatus or the like is significantly changed in various characteristics by entering and releasing of moisture. The water content rapidly fluctuates particularly during a time until the sheet material reaches an equilibrium state with ambient environment (particularly, temperature and humidity). This time corresponds to a time immediately after the sheet material is taken out from a package having high air tightness, a time immediately after the sheet material is dried by heating in a fixing step by a copying machine or the like, a time immediately after image formation using ink by an ink jet printer, or the like. Accordingly, there is a problem in that, even when the water content is detected, a value fluctuates after a time required for conveying or temporarily storing the sheet material has elapsed after the detection, so that various set conditions for handling the sheet materials deviate from an appropriate range. This is a significant problem particularly in image formation by a printer for successively performing a plurality of processings such as transfer, fixation, and the like of coloring materials while conveying the sheet material.

For this problem, there is proposed to provide water content sensors in a storage unit and a conveying path for the sheet material to detect the water content of the sheet material and reflect the detection result to a charging voltage, a separation voltage, a fixing temperature, and the like.

Japanese Patent Application Laid-Open No. H07-234556 discloses an image formation apparatus including water content sensors, which are provided in a storage unit for the sheet material and a reverse conveying path for two-side printing, for detecting an infrared absorption peak. The water content of the sheet material detected by the water content sensor is reflected to a charging voltage and a separation voltage of the image formation apparatus. The water content which has changed due to a fixing processing on one surface is detected by the water content sensor on the reverse conveying path, and the charging voltage and the separation voltage are optimized for image formation on the other side.

Japanese Patent Application Laid-Open No. H11-202686 discloses an image formation apparatus in which humidity in a sheet material conveying space is detected to estimate a water content of a sheet material, and processing conditions for image formation are adjusted based on the estimated water content. In this case, moisture contained in the sheet material is forcibly allowed to evaporate by using heat of a fixing roller, humidity in the sheet material conveying space which changes according to an amount of water vapor generated thereby is detected, and the water content of the sheet material is estimated from the humidity. The detection of humidity is performed at a predetermined time after the sheet material passes the fixing roller. Therefore, the water content can be estimated separately for each sheet material. Accordingly, processing conditions can be adjusted following the water content of the sheet material, which fluctuates from moment to moment.

Japanese Patent Application Laid-Open No. H05-204411 discloses a sheet feed apparatus in which fuzzy inference is executed based on humidity inside the sheet feed apparatus and a time derivative value of the humidity, thereby performing an ON/OFF control of a heater.

A general sheet material is thin and moisture enters and is released from a surface thereof due to a humidity difference with respect to environment. Therefore, there is a possibility of the water content of the sheet material changing according to temperature and humidity of a space where the sheet material is conveyed and processed, and elapsed time therefor.

In the image formation apparatus disclosed in Japanese Patent Application Laid-Open No. H07-234556, the water content of a sheet material is detected in a state where sheet materials are stacked in the storage unit. Processing conditions for image formation are set according to the water content of the sheet material in the state where the sheet materials are stacked in the storage unit.

Accordingly, after the sheet material is taken out from the storage unit, the sheet material is conveyed in the image formation apparatus and waits on the conveying path, until a moment at which the sheet material is actually subjected to image formation, there is a possibility of the water content having been changed. In this case, image formation is performed on the sheet material under processing conditions improper for the sheet material changed in water content.

For example, when, with respect to the sheet material increased in water content by being exposed to high humidity in the image formation apparatus, the processing is performed with a transferring bias voltage and a separation bias voltage being optimized according to the water content of the dried sheet material detected in the storage unit, there may be a risk of interfering transfer of a toner image and separation of the sheet materials. In other words, at a fixing temperature optimum for the dried sheet material, the toner image cannot be sufficiently fixed to the sheet material increased in water content.

In the image formation apparatus disclosed in Japanese Patent Application Laid-Open No. H11-202686, the water content of the sheet material on which image formation is completed (image is fixed) is discriminated. Therefore, the discriminated water content does not necessarily match with a water content of the sheet material to be subjected to image formation. When a water content of a first sheet and a water content of a second sheet material are different from each other, processing conditions set according to the water content of the first sheet material is inappropriate for the second sheet material.

In an image formation apparatus disclosed in Japanese Patent Application Laid-Open No. H05-204411, a water content in an atmosphere inside the image formation apparatus can be predicted accurately to some extent. However, the water content of the sheet material itself is not detected. Therefore, when the water content is different among the sheet materials, processing conditions cannot be controlled appropriately in some cases. In general, the sheet materials are accommodated in the image formation apparatus in a state where several tens to several hundreds of sheet materials are stacked on one another. Water contents of the sheet materials differ from one another according to a position of each sheet material in the stacked sheet materials. Specifically, an uppermost sheet material has a surface exposed to an atmosphere, so that the equilibrium state of the water content thereof is easily achieved, and the water content is close to a water content of the atmosphere where the sheet material is stored. On the other hand, the water content of the sheet material in the stacked sheet materials is different from the water content of the atmosphere because the sheet material is sandwiched between the other sheet materials and movement of moisture thereof with respect to the atmosphere is limited. For example, the first sheet material and the tenth sheet material are different from each other in water content. Particularly in a case immediately after sheet materials are newly supplied, or the like, a water content of the sheet material and the water content of the atmosphere inside the image formation apparatus are not equilibrated, and the water contents of the sheet materials are considerably different from one another. This is because it takes substantially long time for achieving an equilibrium state between water contents of the sheet material and humidified atmosphere in the image formation apparatus. Therefore, the water content contained in the sheet material cannot be unambiguously determined only from the water content of the atmosphere inside the image formation apparatus. As a result, even when the water content of the atmosphere can accurately be predicted, processing conditions may not be controlled appropriately in some cases.

SUMMARY OF THE INVENTION

An object of the present invention is to provide a water content estimation apparatus, a water content estimation method, a sheet material processing apparatus, and a sheet material processing method capable of predicting change in water content after detection thereof and determining, before the processing, the water content of the sheet material when a processing is actually performed on the sheet material in an accurate manner as compared to a conventional manner.

According to a first aspect of the present invention, a water content estimation apparatus is provided which include: a first detection unit for detecting a first information regarding a water content of a sheet material at a position in contact with or adjacent to the sheet material; a second detection unit for detecting a second information regarding at least one of factors that change the water content of the sheet material from a conveyance of the sheet material detected by the first detection unit until a performance of a processing, results of the processing being affected by the water content of the sheet material; and an estimation computation unit for computing, based on the detection results obtained by the first detection unit and the second detection unit, an estimation of the water content of the sheet material when the processing is performed with respect to the sheet material.

Further, according to a second aspect of the present invention, a sheet material processing apparatus is provided which includes: the above-described water content estimation apparatus; a processing unit for performing the processing with respect to the sheet material which is conveyed; and a control unit for controlling the processing unit and determining processing conditions for the sheet material in the processing unit, based on the water content of the sheet material estimated by the water content estimation apparatus.

Still further, according to a third aspect of the present invention, a water content estimation method is provided which includes: a first step of detecting a first information regarding a water content of a sheet material before a step of performing a processing, results of the processing being affected by the water content of the sheet material; a second step of detecting a second information regarding a factor that affects a change in the water content of the sheet at an interval from the detection of the first information until the performance of the processing; and a third step of computing, based on the first information and the second information, an estimation of the water content of the sheet material when the processing is actually performed.

Yet further, According to a fourth aspect of the present invention, a sheet material processing method of performing a processing, the results of the processing being affected by a water content of a sheet material, is provided which includes: a first step of detecting a first information regarding the water content of the sheet material before performing the processing; a second step of detecting a second information regarding a factor that affects a change in the water content of the sheet material from the detection of the first information until the performance of the processing; a third step of computing, based on the first information and the second information, an estimation of the water content of the sheet material when the processing is performed; and a fourth step of determining processing conditions in the processing based on the estimation of the water content which is computed.

Further features of the present invention will become apparent from the following description of exemplary embodiments with reference to the attached drawings.

DESCRIPTION OF THE EMBODIMENTS

Figure 1:
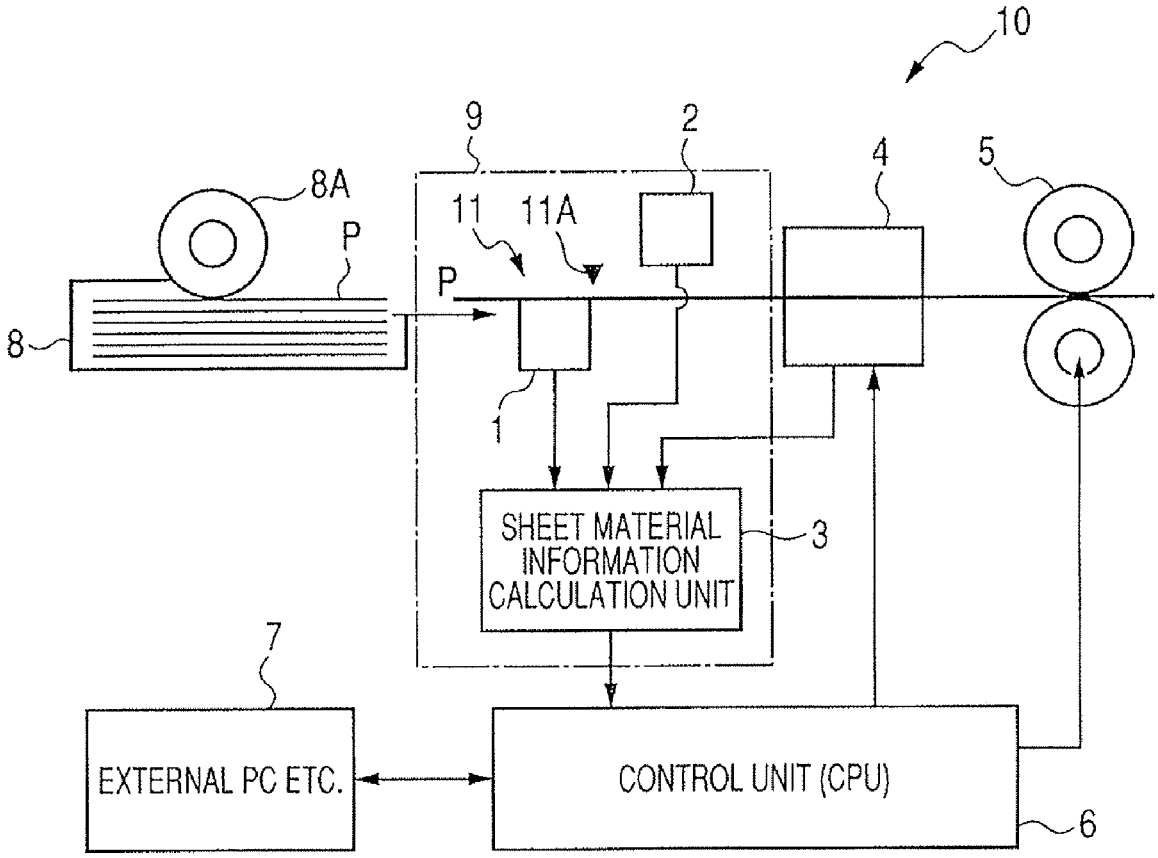
FIG. 1 is an explanatory diagram of a structure of an image formation apparatus according to a first embodiment of the present invention.

Hereinafter, a detailed description will be made of an image formation apparatus according to an embodiment of the present invention with reference to the drawings. A water content estimation apparatus of the present invention is not limited to exclusive structures according to embodiments described below. As long as processing conditions are adjusted based on the water content of a sheet material, modifications are possible in which a part or whole of a structure of each embodiment is replaced with an alternative structure.

Examples of a first detection unit to be used in the present invention, which is provided at a position in contact with or adjacent to the sheet material, for detecting a first information regarding the water content of the sheet material include the followings.

(1) A unit for measuring the water content itself of the sheet material; an example thereof includes a unit which applies an electromagnetic wave such as infrared ray or microwave, or radiation ray such as β ray to measure absorption of the electromagnetic wave or the radiation ray by moisture contained in the sheet material.

(2) A unit for measuring humidity in the vicinity of the sheet material; an example thereof includes a humidity sensor. The unit may be of any system. However, a system that electrically detects fluctuation in thermal property of particularly water vapor-containing air due to humidity can be adopted because this system realizes high-speed measurement. The humidity sensor is provided as close as possible to the sheet material to measure fluctuation in humidity due to the moisture entrance to and release from the sheet material and dispersion in the sheet material. In this case, as standard data, humidity in a case where a distance between the humidity sensor and the sheet material is large (that is, in a state where the sheet material is not conveyed to the vicinity of the humidity sensor, or the like) may be measured as a relative value. It is also desirable that a calibration curve of a relationship between the measured humidity and the water content of the sheet material be made in advance, and the measured humidity is converted to be outputted as the water content of the sheet material. By using the unit as described above, the estimation can be performed with substantially the same accuracy as in a case of directly measuring the water content of the sheet material itself.

(3) A unit for measuring a physical value which fluctuates according to the water content of the sheet material; the unit measures that almost all the physical values of the sheet material change according to the water content thereof. According to the present invention, specific examples of the physical value include the followings:

(3-1) electrical characteristics such as electrical resistance, surface resistance (including a difference between front and back surfaces), resistance in a thickness direction, and a capacity (dielectric constant);

(3-2) thermal property such as thermal diffusivity; and (3-3) optical property such as reflectance (determined according to surface roughness which fluctuates due to, in particular, fiber swelling resulting from moisture absorption), and chroma.

Examples of a processing of which results are affected by the water content of the sheet material used in the present invention include printing processings of an electrophotographic system, ink jet system, thermal transfer system, and sublimation system.

A second detection unit used in the present invention may be any unit capable of detecting at least one factor of changing the water content of the sheet material in a time from the detection by the first detection unit to execution of the above-mentioned processing. Examples of the factor include temperature of a space where the processing is performed, temperature of a member for supporting the sheet material, time from the measurement of the water content of the sheet material by the measurement unit to execution of the processing (waiting time), environmental humidity, environmental temperature, and a midpoint processing.

Specific examples of the second detection unit include an environmental sensor such as a temperature sensor and a humidity sensor, a resistance meter for detecting information on the sheet material, which fluctuates due to the change in the water content, and for detecting characteristics of the sheet material, a sensor for measuring heat conductivity (which is constructed of a heating system including a heater, and a temperature sensor), and a reflectometer.

An example of the humidity sensor serving as the first or second detection unit to be used in the present invention includes a heat conductive humidity sensor having high output responsiveness to humidity change, as disclosed in Japanese Patent Application Laid-Open No. H09-005284. The heat conductive humidity sensor measures humidity by using a fact that thermal diffusion from heat-sensitive resistor generating Joule heat fluctuates according to the humidity. The heat conductive humidity sensor is formed with the heat-sensitive resistor having an extremely small heat capacity by using a micro-electro-mechanical system (MEMS) technology (microprocessing technology based on integrated circuit processing technology). Therefore, the heat conductive humidity sensor is characterized in that the output responsiveness is significantly high.

An example of an estimation computation unit used in the present invention includes a calculation unit in which an output value obtained by the second detection unit is converted into information corresponding to the water content of the sheet material, specifically a circuit including a memory and a calculating element. Examples of a calculation technique include a system of converting from a data table to a reference value, and a converting system of using a transformation equation.

The water content estimation apparatus of the present invention can be mounted onto an image formation apparatus such as a printing apparatus of an electrophotographic system, an ink jet system, or the like, or onto a sheet material processing apparatus, a sheet material stacking apparatus, a sorter, or the like.

The sheet material to be used in the present invention not only refers to cut paper but also collectively refers to thin plate-like materials (recording materials). A form of the sheet material is not limited. The sheet material may be a cut sheet obtained by cutting the sheet material in a predetermined dimension, a rolled material obtained by rolling the sheet material, or the like. There may be adopted a single sheet material, two sheet materials overlapping each other, or two sheet materials adhered to each other. Examples of an object to which the present invention is applied to have a great effect, include normal paper, glossy paper, coat paper, recycled paper, OHP, and the like as a recording medium of which processing results are affected by the water content thereof.

The sheet material information may be information regarding a single (one piece of) cut sheet, information regarding a plurality of cut sheets, or information regarding a long sheet such as rolled paper or a sheet having a large area. Herein, in a case where there is no specific limitation, a description will be made of the information regarding the single cut sheet as an example.

First Embodiment

Figure 2:
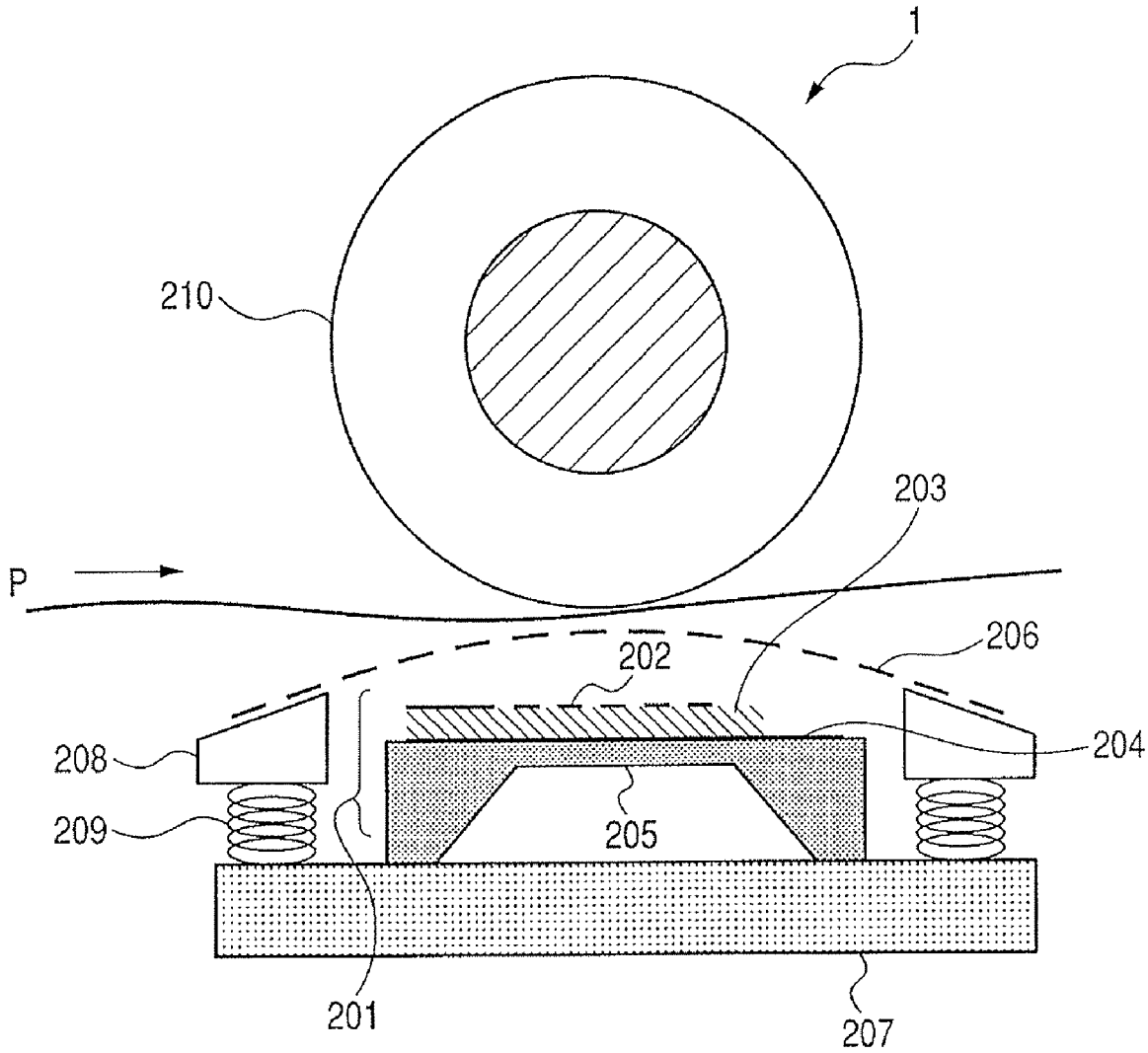
FIG. 2 is an explanatory diagram of a structure of a humidity sensor for detecting a water content of a sheet material.
Figure 3:
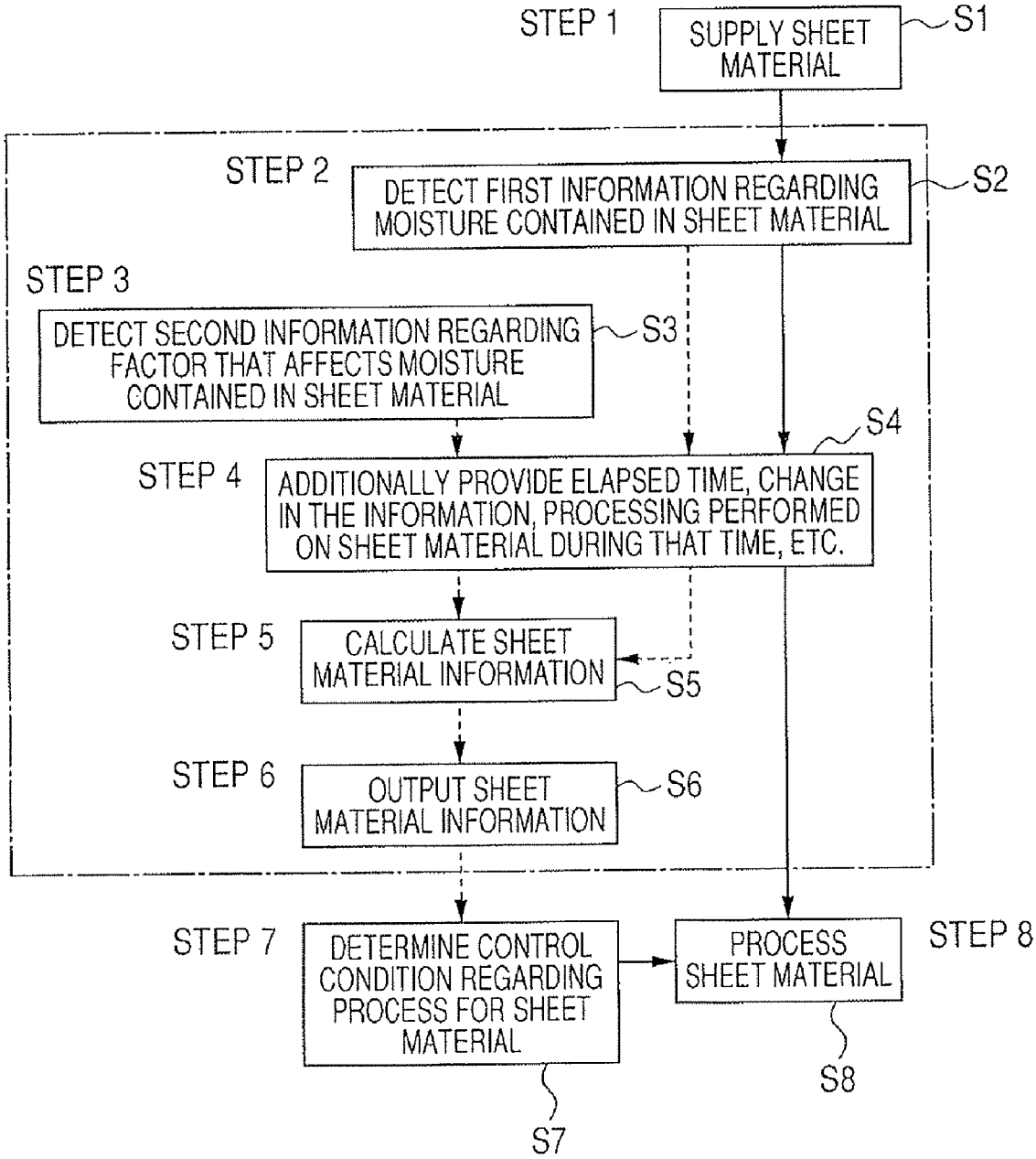
FIG. 3 is a flow chart of control for estimating the water content and setting processing conditions for image formation.
Figure 4:
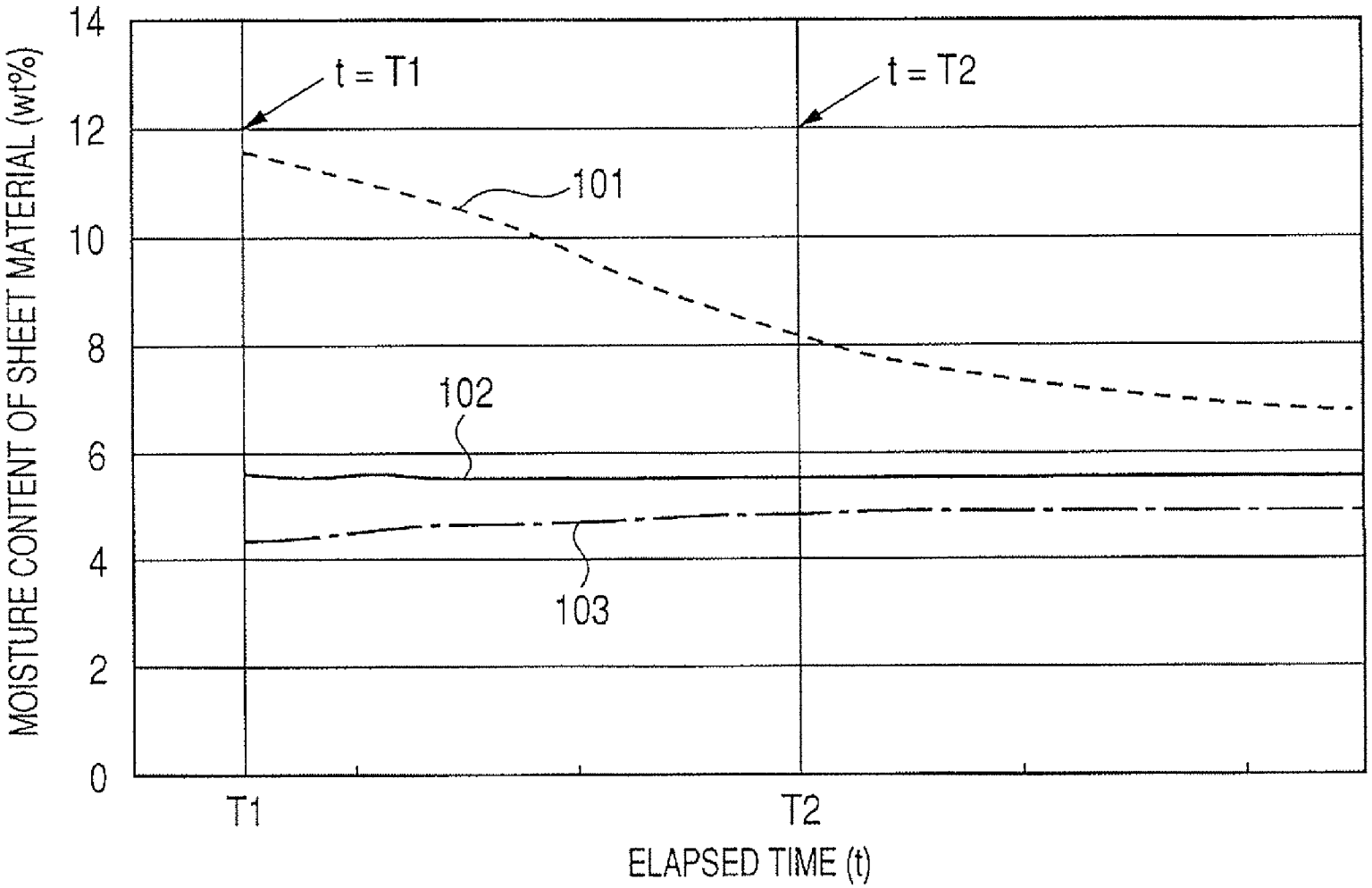
FIG. 4 is a graph of a relationship between the water content and a residence time in a conveying path.

FIG. 1 is an explanatory diagram of a structure of an image formation apparatus according to a first embodiment of the present invention. FIG. 2 is an explanatory diagram of a humidity sensor for detecting a water content of a sheet material. FIG. 3 is a flow chart of control for estimating the water content and setting processing conditions for image formation. FIG. 4 is a graph of a relationship between the water content and a residence time in a conveying path. An entirety of FIG. 1 relates to an example of a sheet material processing apparatus of the present invention, in which a section surrounded by a broken line relates to an example of a water content estimation apparatus.

As illustrated in FIG. 1, in the first embodiment, a description is made of processing of the sheet material by exemplifying a copying machine of an electrophotographic system which is an image formation apparatus. A sheet material information output apparatus 9 includes at least a water content detection unit 1 as an example of a unit for detecting a first information, a factor detection unit 2 for detecting a factor (fluctuation factor) of changing the water content, as an example of a unit for detecting a second information, and a sheet material information calculation unit 3 as an example of a unit for calculating sheet material information. An image formation apparatus 10 as an example of a sheet material processing apparatus includes an image transferring unit 4 and a fixing unit 5 which are examples of a sheet material processing unit, and a control unit (CPU) 6 as an example of a control unit, and is connected to an external PC etc. 7.

In the image formation apparatus 10 according to the first embodiment, sheet materials P stacked on a sheet feed unit 8 are fed into a conveying path 11 while being separated one by one by a sheet feed roller 8A. In the conveying path 11, a conveying roller is arranged (not shown) and conveys and feeds the sheet material P to the image transferring unit 4.

The image formation apparatus 10 performs image formation on the sheet material P using an electrophotographic technology. In the image transferring unit 4, there is provided an electrostatic image-bearing member on which optical writing is performed. A latent image optically written on the electrostatic image-bearing member is developed into a toner image. The sheet material P onto which the toner image is transferred by the image transferring unit 4 is fed to the fixing unit 5 to be applied with heat and pressure, so that the toner image is fixed onto a surface of the sheet material P.

The sheet edge detection sensor 11A provided on the conveying path 11 monitors a conveying position of the sheet material P. The sheet material information calculation unit 3 and the control unit 6 determine an operation timing of information detection and the like based on an output of the sheet edge detection sensor 11A. As the sheet edge detection sensor 11A, any sensor capable of detecting the passage of a portion (such as a leading edge) of the sheet material P which is conveyed, such as an optical photo coupler and a dynamic flap sensor, may be used without particular limitation.

The water content detection unit 1 provided on the conveying path 11 transmits an output signal corresponding to a water content of the sheet material P entering the conveying path 11 to the sheet material information calculation unit 3. The fluctuation factor detection unit 2 detects humidity in the conveying path 11 up to the image transferring unit 4, as one of factors which change the water content of the sheet material P (fluctuation factor of environment affecting water content).

The sheet material information calculation unit 3 performs correction calculation of the water content of the sheet material P detected by the water content detection unit 1 based on the environmental humidity or the like detected by the fluctuation factor detection unit 2. Before the sheet material P reaches the image transferring unit 4 and the fixing unit 5, the sheet material information calculation unit 3 performs an estimation computation of the water content of the sheet material P in the image transferring unit 4 and the fixing unit 5.

The control unit 6 of the image formation apparatus 10 adjusts image transferring conditions in the image transferring unit 4 based on the calculated water content of the sheet material P in the image transferring unit 4. In a case where the water content of the sheet material is large, a charging bias voltage applied to a latent image-bearing member is made larger and a separation bias voltage applied to a separation roller is made larger than that in a case where the water content is small.

The control unit 6 of the image formation apparatus 10 adjusts the temperature of a fixing roller in the fixing unit 5 based on the calculated water content of the sheet material P in the fixing unit 5. In a case where the water content is large, a set temperature of the fixing roller is made higher.

The control unit 6 is connected to the external PC etc. 7 through a network, and, according to a print job transmitted from the external PC etc. 7, actuates the image formation apparatus 10 to perform printing on the sheet material P. In the first embodiment, the water content detection unit 1 for detecting the water content of the sheet material P and the fluctuation factor detection unit 2 for detecting environmental humidity are structured separately. Both the water content detection unit 1 and the fluctuation factor detection unit 2 are arranged on an upstream side of the image transferring unit 4 in a conveying direction of the sheet material P.

The water content detection unit 1 and the factor (fluctuation factor) detection unit 2 for detecting a factor changing the water content, according to the first embodiment are humidity sensors each having a main body portion formed of a thin film and outputting a voltage signal according to humidity of air. The water content detection unit 1 detects the humidity of an air space on the surface of the sheet material P, which balances the water content contained in the sheet material P. The factor (fluctuation factor) detection unit 2 detects the environmental humidity in the conveying path 11.

As illustrated in FIG. 2, the water content detection unit 1 having a humidity sensor 201 responding to the humidity, which is provided in close proximity to the sheet material P at a controlled distance therebetween, detects a water content based on the humidity in the vicinity of the sheet material P. In the humidity sensor 201, a three layer structure including an upper electrode 202, a lower electrode 204, and a dielectric film 203 provided therebetween is supported by a substrate 205. Above the humidity sensor 201, a water vapor permeation plate 206 is arranged while being supported by fixing members 208 and springs 209. The springs 209 and the substrate 205 are supported by a pedestal 207. Above the water vapor permeation plate 206, a roller 210 for pressing the sheet material P to the water vapor permeation plate 206 is provided.

The humidity sensor 201 has a structure in which on the substrate 205 etched to a thin plate-like shape, the lower electrode 204 formed of a metal thin film, the dielectric film 203, and the upper electrode 202 formed of a metal thin film and having patterned thin lines are stacked in the stated order. The humidity sensor 201 operates for detecting a capacity change of the dielectric film 203 due to humidity. Alternatively, it may be possible to supply a current to the upper electrode 202 having the same structure as mentioned above and detect a resistance value changed according to a water vapor amount in the air during supply of the current.

The humidity sensor 201 detects humidity in the extreme vicinity of the sheet material P, which fluctuates according to the water content of the sheet material P. The humidity sensor 201 faces the sheet material P through an intermediation of the water vapor permeation plate 206, which allows water vapor to pass therethrough and has a protecting function of preventing itself from being damaged due to contact with the sheet material P.

The sheet material P is interposed between the water vapor permeation plate 206 and the roller 210 and supported by the springs 209. A distance between the pedestal 207, to which the humidity sensor 201 is fixed, and the roller 210, to which the sheet material P is pressed, is maintained constant so that a distance between the humidity sensor 201 and the sheet material P is stably maintained. With this structure, it is possible to estimate the water content with substantially the same accuracy as in the case where the water content of the sheet material itself is directly measured.

As the fluctuation factor detection unit 2 (FIG. 1), there is used a member obtained by packaging a member the same as the humidity sensor 201 of the water content detection unit 1 in a protecting case having an appropriate air permeability.

In the first embodiment, the water content detection unit 1 is provided on the upstream side of the image transferring unit 4 in the conveying path 11 of the image formation apparatus 10. Further, the fluctuation factor detection unit 2 is provided between the water content detection unit 1 and the image transferring unit 4 also in the conveying path 11.

With reference to the flow chart of FIG. 3, a description will be made of an estimation procedure of the water content of the sheet material P and a setting procedure of the processing conditions based on the estimated water content. In FIG. 3, solid lines indicate a flow of the sheet material P due to conveyance and broken lines indicate a flow of information regarding the sheet material information or the sheet material processing.

In a step 1, the control unit 6 allows the sheet material P to be supplied from the sheet feed unit 8 to the image formation apparatus 10 (S1). That is, first, the sheet material P taken out of a package is set to the sheet feed unit 8 for the sheet material P, thereby performing sheet feeding. Second, the sheet material P obtained after completion of the processing is fed to the image formation apparatus 10 again. That is, in a case of performing two-side copying with respect to the single sheet material P or the like, after completion of image formation on a first surface, a predetermined conveyance is performed for image formation on a second surface.

In a step 2, the sheet material information calculation unit 3 detects the first information regarding the water content contained in the fed sheet material P (S2). In the first embodiment, the humidity sensor 201 of the water content detection unit 1 (FIG. 2) detects the water content contained in the sheet material P. A timing for performing the step 2 is prior to the processing of the sheet material P. At least time required for detecting the first information, time required for conveying the sheet material P to the image transferring unit 4, and time required for controlling the sheet material processing in the image transferring unit 4 are secured, and the water content of the sheet material P is detected.

The detection of the first information can be performed for each sheet when the cut sheets are used. Even when the cut sheets are used, in a case where only small fluctuation occurs at the time of feeding a large number of sheets stacked in a stable environment at fixed intervals, the detection may be performed at intervals of several sheets and the estimation computation may be performed. Further, when the roll sheet is used, the detection is performed for each unit of processing, or for each predetermined length. In many cases, the water content of the sheet material P is not uniform in the surface thereof. Therefore, the water content may be detected at a plurality of positions on the single sheet material P.

In a step 3, the sheet material information calculation unit 3 detects information (fluctuation factor) constituting a factor of changing the water content contained in the sheet material P, which is detected in the step 2, until the transferring processing is performed by the image transferring unit 4 (S3). The image formation apparatus 10 according to the first embodiment is a copying machine. Considering that the image formation apparatus 10 is installed in an interior of an office or the like, humidity in the conveying path 11 of the image formation apparatus 10 is detected as the second information.

The step 3 can be performed between the step 2 and the transferring processing. In a case where an environmental change is not rapid, the step 3 may be performed before the step 2 or simultaneously with the step 2. Further, the step 3 is continued for a long time until around the transferring processing and the environmental change is also included in the second information, thereby increasing the accuracy of the detection.

In a step 4, necessary information regarding matters affecting the water content contained in the sheet material P at a time point at which the transferring processing is actually performed is obtained to be taken into consideration (S4). Specifically, the matters include the followings:

(1) elapsed time from the detection of the first and second information to the transferring processing;

(2) change in the first and second information;

(3) a process, heating, cooling, humidity control, ventilation, light radiation, or the like applied to the sheet material P during time from the detection of the first information to the transferring processing; and (4) another information on the sheet material P (for example, artificial input of model number of sheet to be set or signal from a sensor provided separately).

In a step 5, information regarding the water content of the sheet material is calculated from pieces of information obtained through the preceding steps (S5). The sheet material information calculation unit 3 calculates the water content of the sheet material P to be used for controlling the image transferring unit 4 from the first information and the second information. In the first embodiment, an estimation of change in the water content of the sheet material P from detection of the first information to performance of the transferring processing with respect to the sheet material is computed. An elapsed time, change in information, a process performed on the sheet material P during this time, and the like are considered additionally with the first information and the second information, and then the estimation of water content of the sheet material P is computed to be outputted to the control unit 6.

An example of calculation of information on the sheet material P is illustrated in FIG. 4. As illustrated in FIG. 4, curves 101, 102 and 103 are examples of conversion curves f(t) of the water content (water content wt %) of the sheet material P as a function of time. In FIG. 4, a time point T1 is a time point of obtaining the first information, a time point T2 is a time point of performing the transferring processing with respect to the sheet material P. The curve 101 is a conversion curve f(t) of the sheet material P when the water content of the sheet material P at the time point T1 as the first information is about 12%. Similarly, the curve 102 is obtained when the water content at the time point T1 is about 5%, and the curve 103 is obtained when the water content at the time point T1 is about 4%.

The curves 101, 102 and 103 are examples in a case where humidity in the sheet material conveying path as the second information is about 40% RH. As a matter of course, in a case other than that illustrated in FIG. 4, the conversion curve f(t) is used after making a selection from a plurality of curves according to values of the first information and the second information or after appropriate correction.

That is, according to the first information and the second information to be inputted, the sheet material information calculation unit 3 selects the curves 101, 102, and 103 or the conversion curve f(t) obtained by correcting the curves 101, 102 and 103. Further, the estimation of the water content (water content wt %) of the sheet material P at the time point T2 is computed from the conversion curve f(t).

In a case where a time from the time point T1 of detecting the first information to the time point T2 of performing the transferring processing is within a fixed range, or the like, the sheet material information calculation unit 3 can also compute the estimation of the water content (water content wt %) of the sheet material P only from the first information and the second information.

In a step 6, the estimation of the water content of the sheet material P which is computed by the sheet material information calculation unit 3 in the step 5 is outputted to the control unit 6 for performing control of the image formation apparatus 10 (S6). The steps 1 to 6 described above constitute a method of outputting the sheet material information according to the first embodiment.

In a step 7, the control unit 6 determines the transferring conditions in the image transferring unit 4 and fixing conditions in the fixing unit 5 based on the water content of the sheet material P outputted by the sheet material information calculation unit 3 in the step 6 (S7). In the first embodiment, based on the estimation of the water content of the sheet material P computed by the sheet material information calculation unit 3, the control unit 6 controls the transferring conditions and fixing conditions of the toner of the copying machine at optimum values.

In a step 8, the control unit 6 performs the control under the conditions determined in the step 7 to process the sheet material P (S8).

According to the first embodiment as described above, the water content of the sheet material P which changes during progression of the process is estimated with high accuracy, and an information output or (image forming) processing is performed, thereby enabling process control with high accuracy. The image forming conditions are controlled at an optimum value based on the water content of the sheet material P, so that high-quality copying can be performed.

Modification of First Embodiment

In the first embodiment, first, with respect to the sheet material P to be supplied, the sheet material information calculation unit 3 performs detection of the first information. The first information is information regarding the moisture contained in the sheet material, which is the water content of the sheet material P itself at a certain time point or various characteristics of the sheet material P which fluctuate according to the water content.

In the detection of the water content of the sheet material P itself, humidity in the vicinity of the sheet material may be detected and converted. However, the detection may be performed by using, for example, absorption characteristics of water molecules of an electromagnetic wave (such as infrared ray or microwave). The above-mentioned heat conductive humidity sensor as disclosed in Japanese Patent Application Laid-Open No. H09-005284 may be used.

Examples of the various characteristics of the sheet material P which fluctuate according to the water content of the sheet material P include the followings:

(1) mechanical characteristics including: bending rigidity; compressing rigidity in a thickness direction, viscoelasticity; coefficient of restitution; and acoustic absorption characteristics;

(2) electrical characteristics including: electrical resistance; and dielectric constant;

(3) optical characteristics including: reflectance; absorbance; and color; and (4) a shape including: thickness; roughness; length; and width.

In a case where the water content of the sheet material P is managed in a sufficient range, the sheet material information calculation unit 3 can use the management information as the first information. For example, the case refers to a case where the sheet material P is supplied from a hermetically sealed package in which the water content is managed.

Further, the sheet material information calculation unit 3 detects the second information regarding factors of affecting the information regarding the water content contained in the sheet material P. The second information is environmental information in the vicinity of the sheet material P. Examples of the environmental information include the followings:

(1) temperature including: air temperature and member temperature;

(2) humidity including: relative humidity and absolute humidity; and (3) heat source including: quantity of light and radiation heat.

The second information is obtained at a position as close as possible to the sheet material P. Further, multiple pieces of second information can be obtained. A plurality of types of second information may be obtained or the same type of second information may be obtained in chronological order.

Further, the second information includes a time period in which the sheet material P is under the above-mentioned environment. The time period is a time period required for storage, passage due to conveyance, and the like. Further, the second information also includes information regarding an intermediating member (for example, stacked sheet material) between a detection unit for the second information and the subject sheet material.

In the image formation apparatus 10 according to the first embodiment, a single water content detection unit 1 and a single fluctuation factor detection unit 2 are provided. However, a plurality of water content detection units 1 and a plurality of fluctuation factor detection unit 2 may be provided. By providing the plurality of water content detection unit 1, distribution of the water content of the sheet material P can be detected. Further, by providing the plurality of fluctuation factor detection unit 2, a humidity change along the conveying path 11 can be additionally detected, so estimations of increase and decrease in water content of the sheet material P can be accurately computed.

According to the image formation apparatus 10 of the first embodiment, information of the sheet material P (in particular, water content) is detected and the obtained data is processed, whereby the process control can be performed with high accuracy. In particular, the information (in particular, water content) of the sheet material which changes during progression of the process is estimated with higher accuracy and the information output or (image formation) processing can be performed.

The sheet material information output apparatus 9 of the first embodiment includes the water content detection unit 1 for detecting the first information regarding the water content of the sheet material P at a position coming into contact with or in the vicinity of the sheet material P. The sheet material information output apparatus 9 further includes the fluctuation factor detection unit 2 and the sheet material information calculation unit 3. The fluctuation factor detection unit 2 detects the second information regarding at least one of factors that change the water content of the sheet material P after the sheet material P undergoes the detection by the water content detection unit 1 and is conveyed until the execution of the processing of which the results are affected by the water content of the sheet material P. The sheet material information calculation unit 3 computes the estimation of the water content of the sheet material P when the processing is performed with respect to the sheet material P based on the detection results obtained by the water content detection unit 1 and the fluctuation factor detection unit 2.

In the sheet material information output apparatus 9, without directly using the water content detected by the water content detection unit 1, based on the factor detected by the fluctuation factor detection unit 2, the information regarding the water content detected by the water content detection unit 1 can be corrected. The fluctuation factor detection unit 2 detects at least one of factors that change the water content of the sheet material P, such as environmental temperature, environmental humidity, midpoint processing, waiting time, and physical properties of the sheet material P. The sheet material information calculation unit 3 also gives consideration to the detection results obtained by the fluctuation factor detection unit 2, thereby reducing uncertainty of the information regarding the water content due to the factors. Therefore, the sheet material information calculation unit 3 can more accurately determine the water content of the sheet material P when the sheet material P is actually processed.

Accordingly, fine adjustment of processing conditions based on the water content of the sheet material P is performed, whereby the desired processing of the sheet material P can be performed.

The water content detection unit 1 in the sheet material information output apparatus 9 according to the first embodiment is a humidity sensor. The fluctuation factor detection unit 2 detects, as the factor, at least one factor selected from the group consisting of humidity of a space where the processing is performed, temperature of the space where the processing is performed, temperature of the member for supporting the sheet material P, time from the detection of the first information of the sheet material P by the water content detection unit 1 to the start of the processing, environmental humidity, environmental temperature, and midpoint processing.

The image formation apparatus 10 according to the first embodiment includes the sheet material information output apparatus 9, the image transferring unit 4 for performing the processing with respect to the conveyed sheet material P, the fixing unit 5, and the control unit 6 for controlling the image transferring unit 4 and the fixing unit 5 and determining processing conditions for the sheet material P in the image transferring unit 4 and the fixing unit 5 according to the water content of the sheet material P estimated by the sheet material information output apparatus 9.

The image transferring unit 4 and the fixing unit 5 of the image formation apparatus 10 constitute an image formation unit of an electrophotographic system in which a toner image is transferred onto the sheet material P and fixed thereto through heating and pressing. The control unit 6 adjusts at least one of the transferring conditions and fixing conditions for the toner image based on the estimated water content.

In the first embodiment, before the step of performing the processing of which the results are affected by the water content of the sheet material P, the following steps are performed. That is, the step 2 of detecting the first information regarding the water content of the sheet material P (S2), the step 3 of detecting the second information regarding the factor affecting change in the water content in a time from the detection of the information to the start of the processing (S3), and the step 5 of computing an estimation of the water content of the sheet material P when the processing is performed based on information obtained in the step 2 (S2) and the step 3 (S3).

In the first embodiment, before the step of performing the image formation processing of which the results are affected by the water content of the sheet material P, the following steps are performed. That is, the step 2 of detecting the first information regarding the water content of the sheet material P (S2), the step 3 of detecting the second information regarding the factor affecting change in the water content in the time from the detection of the first information to the start of the processing (S3), the step 5 of computing the estimation of the water content of the sheet material P when the processing is performed based on information obtained in the step 2 (S2) and the step 3 (S3) (S5), and the step 7 of determining processing conditions in each of the processings in the image transferring unit 4 and the fixing unit 5 based on the water content estimation computed.

The water content detection unit 1 of the sheet material information output apparatus 9 according to the first embodiment includes the first humidity sensor 201 for detecting the humidity of the air space on the surface of the sheet material P. The fluctuation factor detection unit 2 includes the second humidity sensor 201 for detecting humidity of the space in which the sheet material P is conveyed and subjected to a certain processing.

The fluctuation factor detection unit 2 of the sheet material information output apparatus 9 according to the first embodiment includes a space temperature detection unit for detecting temperature of the space in which the sheet material P is conveyed and subjected to the certain processing.

The function factor detection unit 2 of the sheet material information output apparatus 9 according to the first embodiment includes a clock unit for determining a time from the detection of the water content of the sheet material P by the water content detection unit 1 to the start of the certain processing performed on the sheet material P.

Second Embodiment

Figure 5:
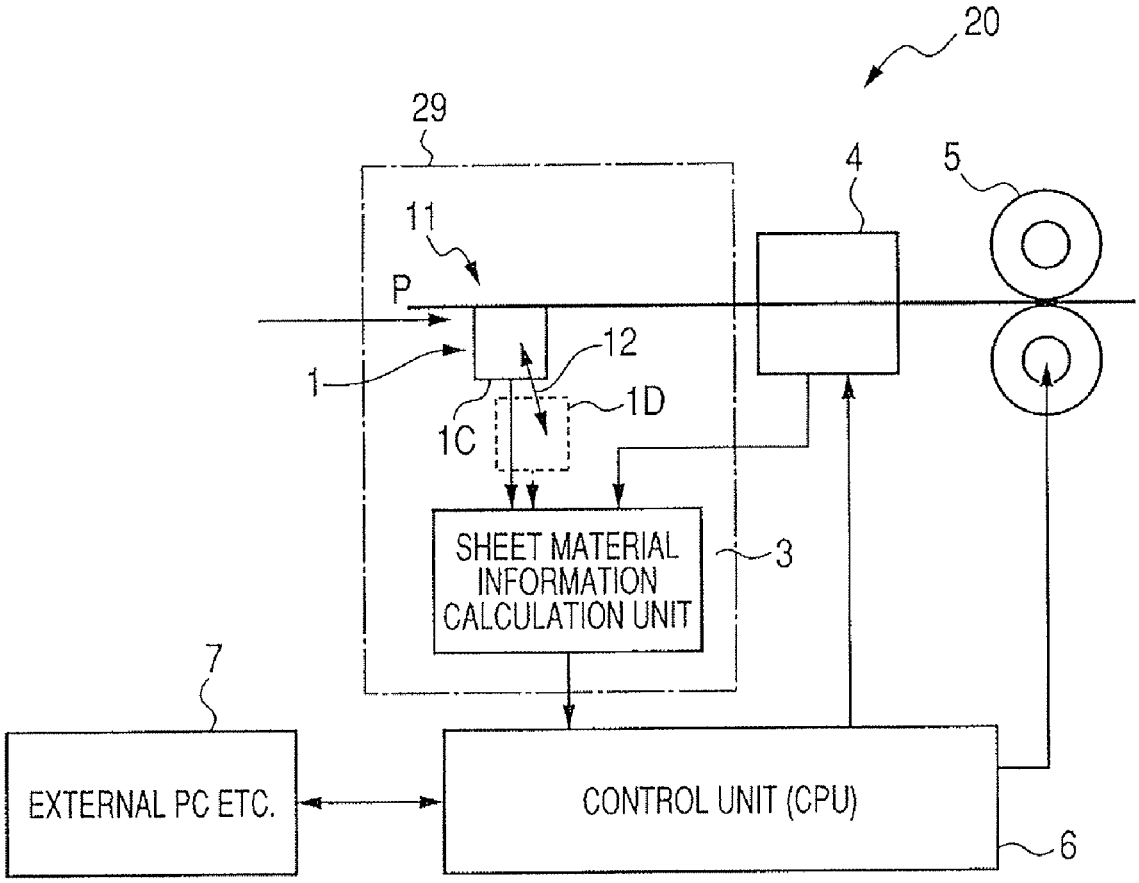
FIG. 5 is an explanatory diagram of a structure of an image formation apparatus according to a second embodiment of the present invention.

FIG. 5 is an explanatory diagram of a structure of an image formation apparatus according to a second embodiment of the present invention. An image formation apparatus 20 according to the second embodiment is an example in which a function of detecting a second information is added to the unit for detecting the first information according to the first embodiment. Accordingly, in FIG. 5, the same structures as those of FIG. 1 are denoted by the same reference characters, and detailed descriptions of those are omitted.

For each of the water content detection unit 1 and the fluctuation factor detection unit 2 illustrated in FIG. 1, the common humidity sensor 201 illustrated in FIG. 2 is used. Therefore, the function of the fluctuation factor detection unit 2 can be provided to the water content detection unit 1. That is, by providing a function of detecting the second information to the unit for detecting the first information, the unit for detecting the first information can also serve to detect the second information. This refers to a case where the unit for detecting the first information can detect humidity.

As illustrated in FIG. 5, the water content detection unit 1 moves between a position 1C for the water content detection, which is brought into contact with the sheet material P by a relative position control mechanism 12, and a position 1D for the fluctuation factor detection, which floats above the conveying path 11. The water content detection unit 1 allows the humidity sensor 201 illustrated in FIG. 2 to generate an output according to the adjacent air humidity. The water content detection unit 1 can arbitrarily perform control between a contact/non-contact state with respect to the sheet material P by the relative position control mechanism 12. In the second embodiment, the unit for detecting the first information detects the humidity, that is, the unit for detecting the first information also serves to detect the second information. The water content detection unit 1 for detecting the first information and the second information is a humidity sensor and a gap or the contact/non-contact state between the water content detection unit 1 and the sheet material P is controlled by the relative position control mechanism 12.

The relative position control mechanism 12 may be any mechanism capable of controlling relative positions of the sheet material P and the water content detection unit 1 for detecting the first information and the second information, and is a mechanism which moves one of those. The control of the contact/non-contact state may be performed such that the water content detection unit 1 is provided at a position at which the water content detection unit 1 slides with respect to the sheet material P, the first information is obtained when the sheet material P passes therethrough, and the second information is obtained at feeding intervals of the sheet materials. That is, the detection may be performed for the first information and the second information while switching therebetween not by the relative position control mechanism 12 but by conveyance.

The structure of the water content detection unit 1 for detecting the first information and the second information is the same as that of the water content detection unit 1 for detecting the first information according to the first embodiment illustrated in FIG. 2.

In the second embodiment, when the sheet material P comes into contact with the water content detection unit 1 for detecting the first information and the second information, the first information is detected thereby. When the sheet material P is not in contact with the water content detection unit 1, the second information is detected thereby.

More preferably, during a process from a state where the sheet material P is not in contact with, that is, the sheet material P is spaced apart from the water content detection unit 1 to a state where the sheet material P comes into contact therewith, which is realized by gradually making the gap between the sheet material P and the water content detection unit 1 smaller, the second information is continuously or intermittently detected first and the first information is detected last.

Conversely, during a process in which the water content detection unit 1 is moved apart from the sheet material P to enlarge the gap between the water content detection unit 1 and the sheet material P from the state where the sheet material P comes into contact therewith, the first information is detected first, and then, the second information is continuously or intermittently detected. As a result, even in a case where the sheet material P and ambient environment affect each other, a consideration is given to a degree of the effect, and the estimation of the water content of the sheet material P can be computed with high accuracy.

When the sheet material P is on the conveying path 11, the sheet material P is undergoing a mutual diffusion phenomenon in which ambient humidity increases due to moisture transpiration from the sheet material P or in which, conversely, the ambient humidity decreases due to moisture absorption into the sheet material P. That is, in this state, by obtaining information on humidity, which is dependent on a distance with respect to the sheet material, an estimation of humidity in a case where the distance is zero (corresponding to the first information) and an estimation of humidity in a case where an effective distance is large (corresponding to the second information) can be computed.

By this method, the first information and the second information are detected, and in the same manner as that of the first embodiment, the estimation of the water content of the sheet material P is computed and outputted.

According to the second embodiment, the first information and the second information can be detected by the single water content detection unit 1. Therefore, a system can be simplified. Further, by continuously or intermittently detecting the first information and the second information while changing the distance, the estimation of the water content of the sheet material P can be computed with higher accuracy.

The sheet material information output apparatus 29 according to the second embodiment includes the relative position control mechanism 12 which moves the water content detection unit 1 from a position adjacent to the sheet material P to the space so that the water content detection unit 1 also serves as the fluctuation factor detection unit 2.

Modification of Second Embodiment

In the second embodiment, the relative position control mechanism 12 is used to relatively move the water content detection unit 1. However, a conveying mechanism for the sheet material may be used to detect a position where the water content detection unit 1 is adjacent to the sheet material P and a position where the water content detection unit 1 is spaced apart therefrom. The water content detection unit 1 for detecting the first information and the second information is fixed inside the conveying path 11, and the conveying path 11 is arranged such that the water content detection unit 1 comes into contact with the surface of the sheet material P passing through the conveying path 11.

Another preferable example includes a mechanism which allows a stack of the sheet materials P stored while being stacked on one another to be raised and lowered, thereby controlling the gap between the stack and the fixed water content detection unit 1 for detecting the first information and the second information. Further, there may be adopted a mechanism that allows the sheet material P which is being conveyed through the conveying path 11 to be bent to form a loop, and controlling the gap between the sheet material P and the water content detection unit 1 according to a size of the loop.

Third Embodiment

Figure 6:
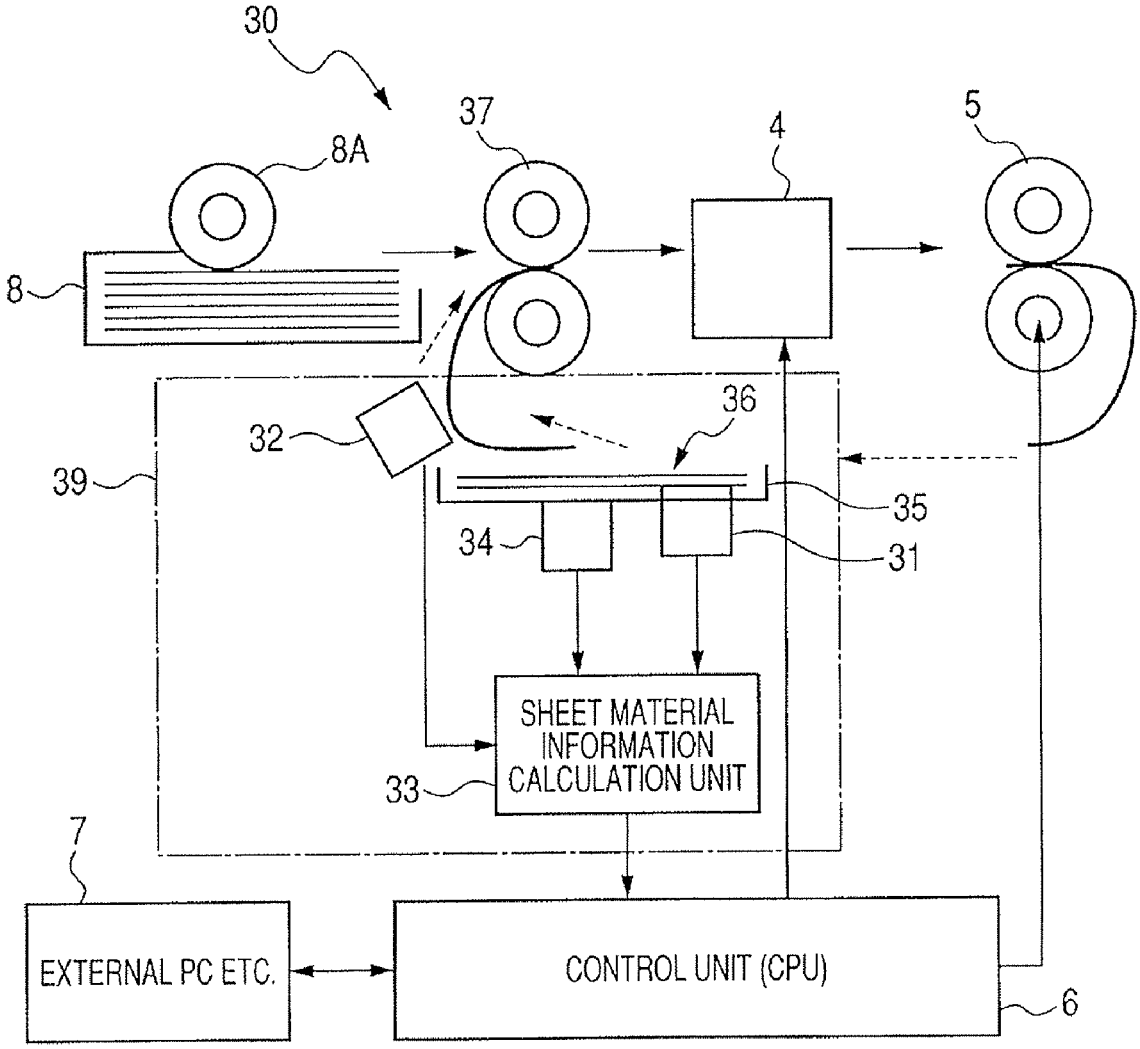
FIG. 6 is an explanatory diagram of a structure of an image formation apparatus according to a third embodiment of the present invention.

FIG. 6 is an explanatory diagram of a structure of an image formation apparatus according to a third embodiment of the present invention. In the third embodiment, in the same manner as in the first embodiment, the estimation of the water content of the sheet material P in the image transferring unit 4 is computed and the transferring conditions in the image transferring unit 4 and the fixing conditions in the fixing unit 5 are set. Accordingly, the same structures as that of FIG. 1 are denoted by the same reference characters and detailed descriptions thereof will be omitted. In the third embodiment, as the subject sheet material P, the sheet material P for two-side copying, on one side of which copying has been performed is adopted. As the processing of the sheet material, image formation is performed on the back side of the sheet material P.

As illustrated in FIG. 6, in the two-side copying, moisture evaporates due to heating in the fixing unit 5 during a one-side copying process, thereby reducing the water content of the sheet material P. In this state, particularly under highly humid environment, the sheet material P rapidly absorbs moisture, so that various characteristics abruptly fluctuate. Accordingly, in order to adjust processing conditions following fluctuations of various characteristics, highly accurate information is required.

Further, the sheet material P after the one-side copying is mainly heated in a process of fixing coloring materials, so the sheet material P is hot. With this heat, ambient air and members such as a conveying path 36 and duplex unit 35 are heated. Increase in the number of sheet material P on which copying is successively performed involves fluctuation (increase) in temperature from several degrees Celsius to about several tens of degrees Celsius.

Each of the above-mentioned members is generally formed of a resin or a metal plate. In order to obtain rigidity higher than that of the sheet material P, the members are thick. The members each have a heat capacity larger than that of the sheet material P, so there is generated a temperature difference between the members and the sheet material P. The temperature difference greatly affects the moisture absorption and moisture transpiration of the sheet material P. Therefore, in the third embodiment, with environmental information that is the second information, member temperature in the vicinity of the sheet material P is detected as a part thereof.

As illustrated in FIG. 6, in the third embodiment, the sheet material P supplied from the sheet feed unit 8 is subjected to image formation on one surface by a route indicated by solid arrows. The sheet material P to be subjected to the two-side copying takes a route indicated by broken arrows after the one-side copying and is subjected to image formation on the other surface via the duplex unit 35. In the third embodiment, the water content detection unit 31 detects the first information from the sheet material P in the duplex unit 35 after the one-side copying. The second information includes temperature information of the duplex unit 35, which is detected by a temperature detection unit 34, and humidity information of the conveying path 36, which is detected by a fluctuation factor detection unit 32.

By the above-mentioned method, the sheet information calculation unit 33 detects the first information and the second information, computes an estimation of the water content of the sheet material P at the time of image transfer on the other surface thereof, and outputs the resultant to the control unit 6. In the third embodiment, the member temperature information of the duplex unit 35 detected as the second information is also used. When the member temperature is high, the conversion curve f(t) illustrated in FIG. 4 is corrected in such a direction that promotes drying of the sheet material P. When the member temperature is low, the conversion curve f(t) illustrated in FIG. 4 is corrected in such a direction that suppresses drying of the sheet material P.

The sheet material P on one surface of which copying has been performed is reduced in water content because moisture thereof has been evaporated due to heating and pressurizing by the fixing unit 5 in the one-side copying process. In this state, particularly under highly humid environment, the sheet material P rapidly absorbs moisture, so various characteristics thereof abruptly fluctuate. In the third embodiment, with respect to the sheet material P after the one-side copying process, of which the physical property rapidly fluctuates due to humidity, information detection can be performed with high accuracy. Therefore, the structure of the third embodiment has a great effect in a case of being applied to the copying on the other surface.

The fluctuation factor detection unit 32 of the sheet material information output apparatus 39 according to the third embodiment includes the temperature detection unit 34 for detecting temperature of the duplex unit 35 which supports the sheet material P which has undergone a heating processing and subjects the sheet material P to a certain processing.

Fourth Embodiment

Figure 7:
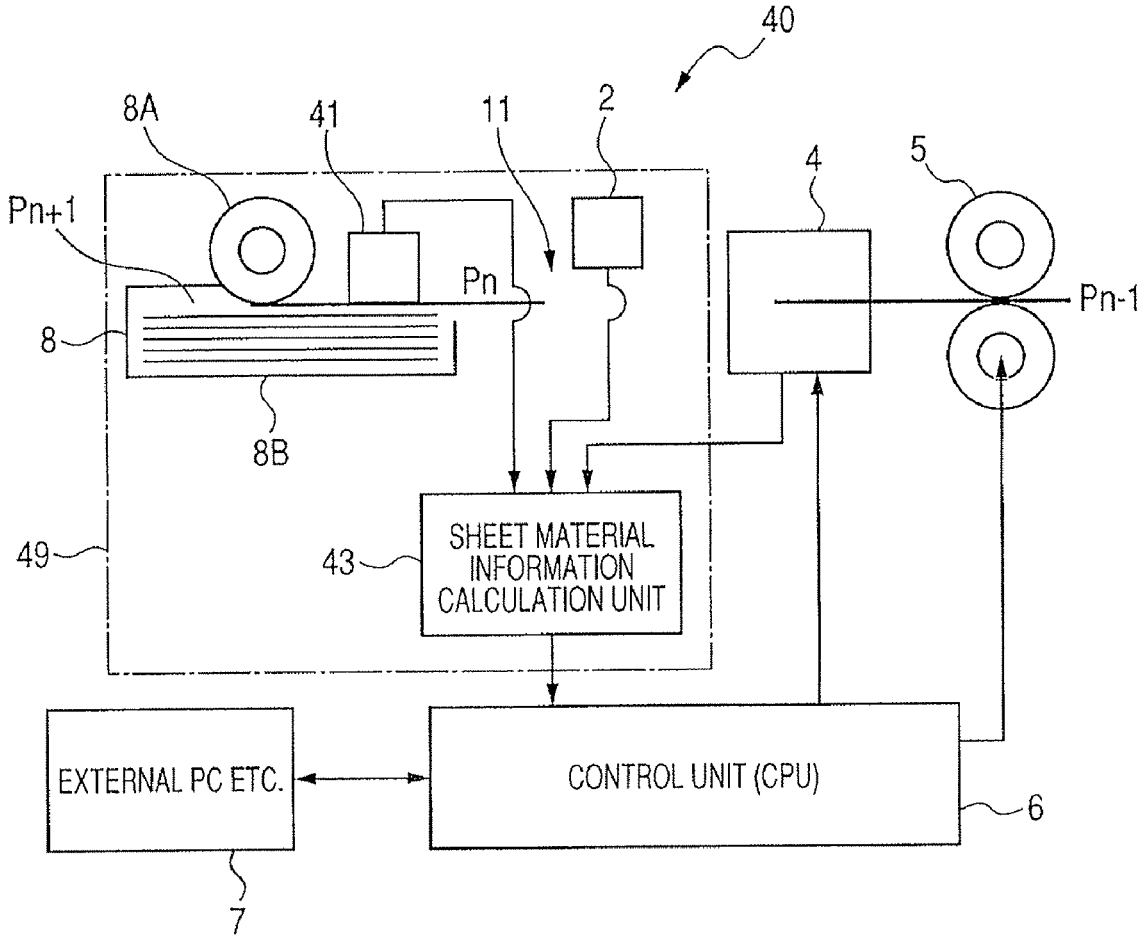
FIG. 7 is an explanatory diagram of a structure of an image formation apparatus according to a fourth embodiment of the present invention.
Figure 8:
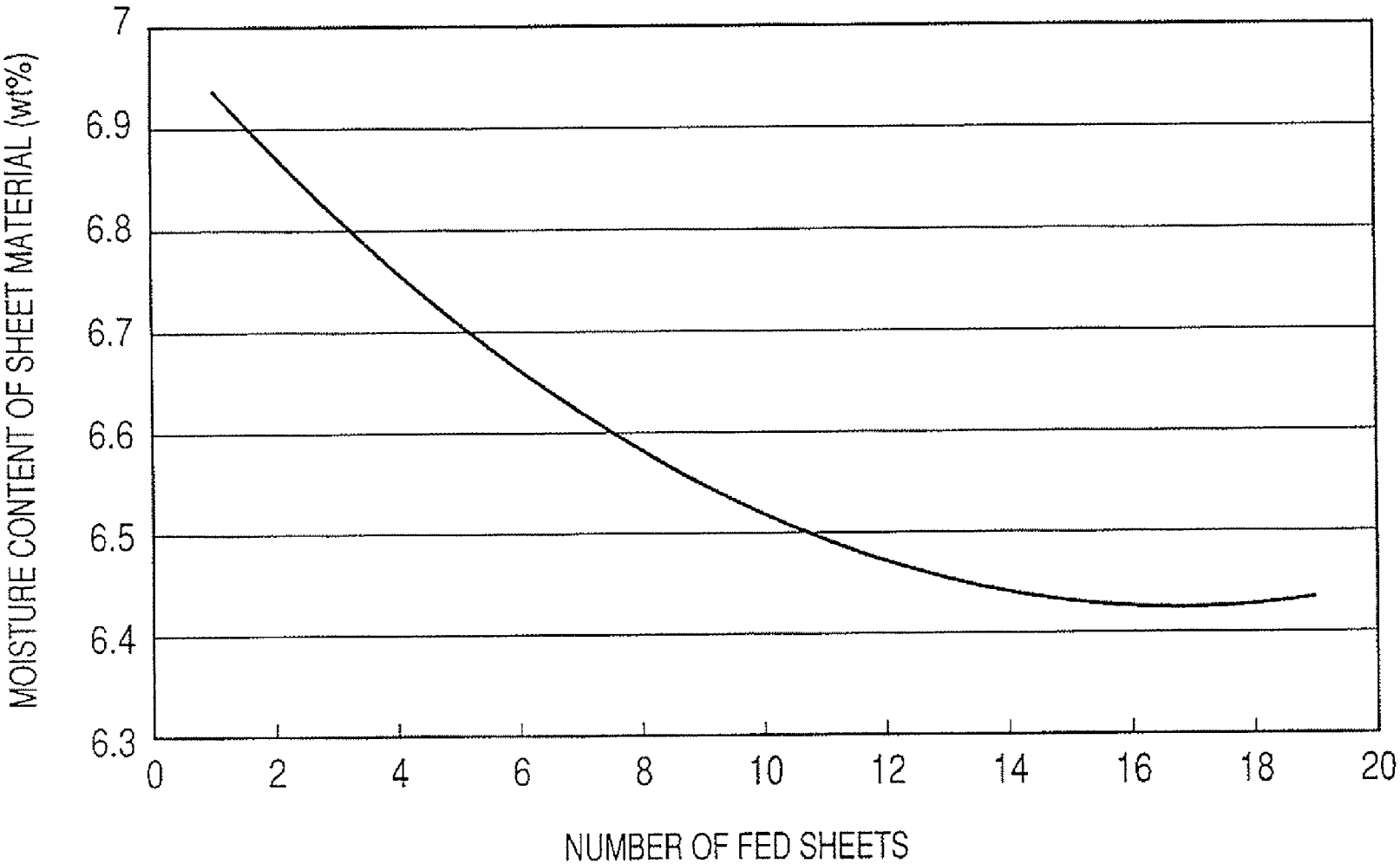
FIG. 8 is a graph of a trend measurement of a water content of stacked sheets.

FIG. 7 is an explanatory diagram of a structure of an image formation apparatus according to a fourth embodiment of the present invention. FIG. 8 is an explanatory diagram of a trend measurement of a water content of stacked sheets. In the fourth embodiment, in the same manner as in the first embodiment, the estimation of the water content of the sheet material P in the image transferring unit 4 is computed, and transferring conditions in the image transferring unit 4 and fixing conditions in the fixing unit 5 are set. Accordingly, the same structures as those of FIG. 1 are denoted by the same reference characters and detailed descriptions of those are omitted. In the fourth embodiment, a description is made of a control for computation of an estimation of a water content of the sheet material P supplied at intervals of a predetermined number of the sheet materials P, in a case where, for example, the plurality of sheet materials P are stacked on one another to be supplied. The state where the plurality of sheet materials P are stacked on one another corresponds to a state where the sheet material P is supplied to the image formation apparatus 40 from stacked cut sheets or a rolled sheet in a roll. In the following, a description will be made of a case where the cut sheets stacked on one another is supplied one by one as an example, but the same description can be made of a case of the rolled sheet.

As illustrated in FIG. 7, in the image formation apparatus 40 according to the fourth embodiment, a sheet material information calculation unit 43 computes an estimation of a water content of the sheet material P, and the control unit 6 sets transferring conditions in the image transferring unit 4 and the fixing conditions in the fixing unit 5 based on the results of the estimation computation. In the fourth embodiment, feeding of the sheet materials P from the sheet feed unit 8 is successively performed starting from the sheet material P exposed on an uppermost surface thereof. The sheet feed unit 8 includes a stacking unit 8B in which the sheet materials P are stacked on one another, and a sheet feed roller 8A.

In the fourth embodiment, influence of environment is exerted upon the sheet materials P from the uppermost surface side (exposed surface side) thereof in a stacking state. Therefore, the first information (humidity of air space on the surface) detected by a water content detection unit 41 greatly fluctuates depending on the number of a sheet material to be detected counting from the uppermost sheet material of the stacked sheet materials. For example, the nth sheet material from the uppermost sheet material of the stacked cut sheets is denoted by reference symbol Pn. A case where the sheet materials P1, P2 . . . are supplied in the stated order from an upper surface side is taken as an example. In this case, a water content of the sheet material P fluctuates according to a numerical value of n of the sheet material Pn. Accordingly, an estimation of a water content of the n+mth sheet material Pn+m can be computed from the first information and the second information of the first sheet material P1.

As illustrated in FIG. 8, a water content of the sheet material P1 to the nineteenth sheet material P19 continuously changes. An example of FIG. 8 is an example of a conversion curve in a case where the stacked cut sheets are supplied at a rate of one sheet per second and at equal intervals in the image formation apparatus 40. The example of FIG. 8 is an example of a conversion curve of sheet material information obtained with respect to the number of sheet materials in a case where the plurality of stacked cut sheets are started to be supplied after being left under an environment in which humidity is higher than the storage environment. The first information of the plurality of stacked cut sheets includes a water content (about 7%) of the sheet material exposed on the uppermost surface of the cut sheets stacked in the sheet feed unit 8. The second information includes environmental humidity, storage time period, and the number of stacked sheets inclusive of the subject sheet from the uppermost surface (number of supplied sheets).

According to the above-mentioned information, the sheet material information calculation unit 43 computes an estimation of the water content of the (n+m)th sheet material Pn+m and outputs the resultant to the control unit 6. The control unit 6 adjusts processing conditions in the image transferring unit 4 and the fixing unit 5 based on the results of the estimation computation.

That is, in the fourth embodiment, when feeding of the sheet material P is started, the sheet material information calculation unit 43 detects the first information from the nth sheet material Pn (for example, first sheet material P1). The sheet material information calculation unit 43 computes the estimation of the water content of the sheet material Pn+m to be supplied afterwards with the second information.

There is a risk that sufficient accuracy cannot be obtained only with the first information detected from the first sheet material P1. Therefore, the first information may be detected from the plurality of sheet materials Pn. Alternatively, the first information may be detected for a plurality of times by performing detection with respect to one sheet material P with time intervals. The first information may be obtained by averaging pieces of first information of the plurality of sheet materials.

In the fourth embodiment of the present invention, before starting of continuous feeding, the sheet material information calculation unit 43 detects the first information from the uppermost sheet material P1 through the water content detection unit 41 and selects the corresponding conversion curve. After the start of the continuous feeding, the sheet material information calculation unit 43 measures environmental humidity and elapsed time constantly as the second information, and corrects, in accordance with the elapsed time, the conversion curve illustrated in FIG. 8 by successively changing the conversion curve according to change in environmental humidity. In this manner, the sheet material information calculation unit 43 computes the estimation of the water content of the (n+m)th sheet material Pn+m when the (n+m)th sheet material Pn+m is actually processed, and outputs the resultant to the control unit 6.

Accordingly, even in the image formation apparatus in which high-speed sheet feeding is performed, a sufficient time for detection of the first information can be ensured, and an estimation of a water content of the sheet material P can be computed with high accuracy. Optimum image formation can be performed on the sheet material P by appropriately performing fine adjustment of processing conditions. Further, processing of the sheet material can be controlled with high accuracy.

A sheet material information output apparatus 49 of the fourth embodiment includes the sheet feed unit 8 in which the sheet materials P are stacked on one another and are subjected to a certain processing. The water content detection unit 41 is provided so as to be capable of detecting a water content of the uppermost sheet material P stacked in the sheet feed unit 8. The sheet material information calculation unit 43 computes, based on the detection results of the water content of the uppermost sheet material P, an estimation of a water content of at least one of the sheet materials P stacked under the uppermost sheet material P.

The image transferring unit 4 and the fixing unit 5 of the image formation apparatus 10 constitute an image formation unit of an electrophotographic system in which a toner image is transferred onto the sheet material P and fixed thereto through heating and pressing. The control unit 6 adjusts at least one of transferring conditions and fixing conditions of the toner image according to the estimated water content.

In the water content estimation apparatus according to the present invention, the water content detected by the first detection unit is not used as it is. Information regarding the water content detected by the first detection unit can be corrected based on factors detected by the second detection unit. The second detection unit detects at least one of factors that change the water content of the sheet material (fluctuation factor of the environment that affects the water content, also simply referred to as function factor), such as environmental temperature, environmental humidity, midpoint processing, waiting time, and physical property of the sheet material.

In this case, representative examples of the above-mentioned midpoint processing include heating processing performed for fixing images on a first surface at the time of two-side copying by a copying machine, application of water such as ink involved in image formation on the first surface by an ink jet printer, and blowing processing used for humidity conditioning, sheet separation, and the like. The estimation computation unit also gives consideration to detection results of the second detection unit and reduces uncertainty of the information regarding the water content due to the corresponding factors. Therefore, the water content of the sheet material when the sheet material is actually processed can be determined more accurately.

Accordingly, a desired processing for the sheet material can be achieved by performing fine adjustment of processing conditions based on the water content of the sheet material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-150706, filed May 30, 2006, which is hereby incorporated by reference herein in its entirety.

What is claimed is:

1. A water content estimation apparatus, comprising:

a first detection unit for detecting a first information regarding a water content of a sheet material at a position in contact with or adjacent to the sheet material;

a second detection unit for detecting a second information regarding at least one of factors that change the water content of the sheet material from conveyance of the sheet material detected by the first detection unit until a performance of image formation processing, results of the image formation processing being affected by the water content of the sheet material, wherein the second information includes at least one of:

(1) temperature including: air temperature and member temperature;

(2) humidity including: relative humidity and absolute humidity; and (3) heat source including: quantity of light and radiation heat; and an estimation computation unit for computing, based on the detection results obtained by the first detection unit and the second detection unit, an estimation of the sheet material water content changed from after conveyance of the sheet material until a performance of the image formation processing.

2. A water content estimation apparatus according to claim 1, wherein the first detection unit comprises a humidity sensor.

3. A sheet material processing apparatus, comprising:

a water content estimation apparatus according to claim 1;

a processing unit for performing the image formation processing with respect to the sheet material which is conveyed; and a control unit for controlling the processing unit and determining image formation processing conditions for the sheet material in the processing unit, based on the water content of the sheet material estimated by the water content estimation apparatus.

4. A water content estimation apparatus according to claim 2, wherein the humidity sensor comprises an upper electrode, a lower electrode and a dielectric film therebetween.

5. A water content estimation method, comprising:

a first step of detecting a first information regarding a water content of a sheet material before a step of performing image formation processing, results of the image formation processing being affected by the water content of the sheet material;

a second step of detecting a second information regarding a factor that affects a change in the water content of the sheet at an interval from the detection of the first information until the performance of the image formation processing; and a third step of computing, based on the first information and the second information, an estimation of a change in water content of the sheet material from after conveyance of the sheet material until performance of the image formation processing.

6. A sheet material processing method of performing image formation processing, a result of the image formation processing being affected by a water content of a sheet material, comprising:

a first step of detecting a first information regarding the water content of the sheet material before performing the image formation processing;

a second step of detecting a second information regarding a factor that affects a change in the water content of the sheet material from the detection of the first information until the performance of the image formation processing;

a third step of computing, based on the first information and the second information, an estimation of a change in water content of the sheet material from after conveyance of the sheet material until performance of the image formation processing; and a fourth step of determining image formation processing conditions in the image formation processing based on the estimation of the water content which is computed.

* * * * *